US005090214A

United States Patent [19]

LoGioco

[11] Patent Number: 5,090,214

[45] Date of Patent: Feb. 25, 1992

[54] SPRAY MATE COOLER

[76] Inventor: Michael J. LoGioco, 2 Inglewood Dr., Hampton, Va. 23666

[21] Appl. No.: 710,744

[22] Filed: May 31, 1991

[51] Int. Cl.[5] ..... F25D 3/08; B67D 5/62

[52] U.S. Cl. ..... 62/457.7; 62/457.1; 62/398

[58] Field of Search ..... 62/457.1, 371, 372, 62/389, 398, 400; 222/146.6

[56] References Cited

U.S. PATENT DOCUMENTS

| | | | |
|---|---|---|---|
| 305,269 | 9/1884 | Barnum | 62/389 |
| 1,812,777 | 6/1931 | Frechou | 62/371 |
| 3,572,054 | 3/1971 | Curcio | 62/390 |
| 4,170,320 | 10/1979 | Eagar | 222/146.6 |
| 4,424,687 | 1/1984 | Morgan | 62/457.1 |
| 4,449,378 | 5/1984 | Thorpe | 62/371 |
| 4,546,900 | 10/1985 | Lackey | 62/457.1 |
| 4,974,426 | 12/1990 | Gomez et al. | 62/457.7 |

*Primary Examiner*—Albert J. Makay
*Assistant Examiner*—William C. Doerrler
*Attorney, Agent, or Firm*—Richard L. Miller

[57] ABSTRACT

A spray mate cooler is provided and consists of a portable ice chest being typically but not necessarily a box-shaped container having bottom, front, back and side inter-connecting walls. A removable lid is supported on the top edges of the box-shaped container so that the box-shaped container can receive and hold a supply of ice therein for cooling. A mechanism is on the bottom wall of the box-shaped container, for elevating the supply of ice to permit cold water of the melted ice to collect on the bottom wall. Another mechanism is for spraying the cold water collected on the bottom wall out through one of the side walls of the box-shaped container.

8 Claims, 1 Drawing Sheet

SPRAY MATE COOLER

BACKGROUND OF THE INVENTION

The instant invention relates generally to portable ice chests and more specifically it relates to a spray mate cooler.

Numerous portable ice chests have been provided in prior art that are adapted to cool drinking liquids stored within the ice chest. For example, U.S. Pat. No. 3,395,550 to Dungan; U.S. Pat. No. 3,498,976 to Michael and U.S. Pat. No. 4,565,074 to Morgan all are illustrative of such prior art. While these units may be suitable for the particular purpose to which they address, they would not be as suitable for the purpose of the present invention as hereafter described.

SUMMARY OF THE INVENTION

A primary object of the present invention is to provide a spray mate cooler that will overcome the shortcomings of the prior art devices.

Another object is to provide a spray mate cooler that will include an elongated hose that fluidly connects a spray nozzle gun to the cold water melted from ice in the cooler so that a person can spray the water therefrom.

An additional object is to provide a spray mate cooler that contains a removable support member for elevating the ice above the elongated hose, so that when the ice melts the water will drip down to cover the end of the tube.

A further object is to provide a spray mate cooler that is simple and easy to use.

A still further object is to provide a spray mate cooler that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENTS

Figure 2:
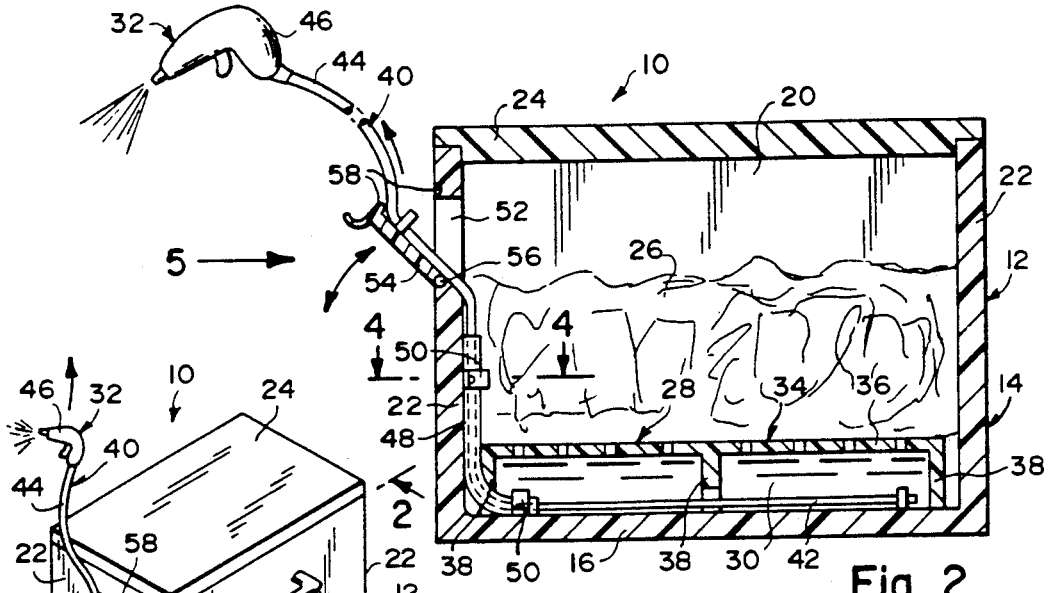
FIG. 2 is a cross sectional view taken on line 2—2 of FIG. 1.
Figure 1:
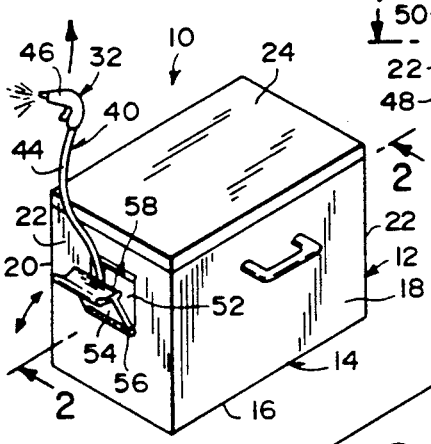
FIG. 1 is a diagrammatic perspective view of the instant invention.
Figure 3:
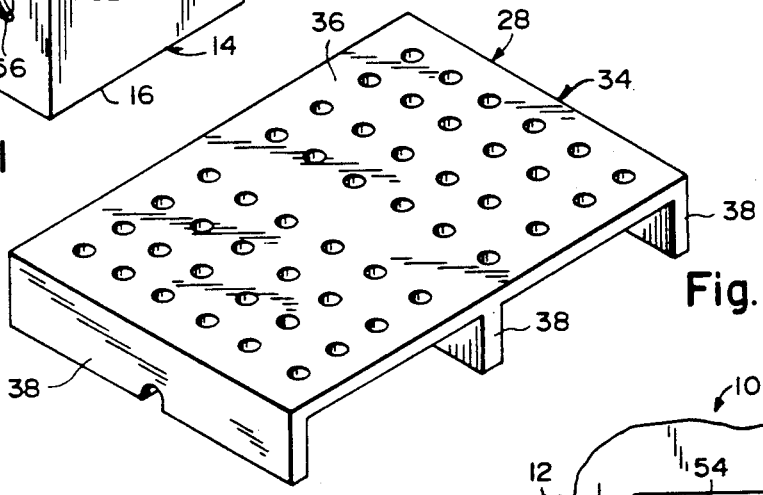
FIG. 3 is a perspective view of the removable support member of the instant invention.
Figure 4:
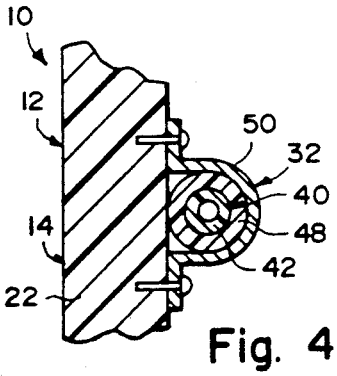
FIG. 4 is an enlarged cross sectional view taken on line 4—4 in FIG. 2, showing a clamp for holding the guide tube with the hose to the wall of the cooler.
Figure 5:
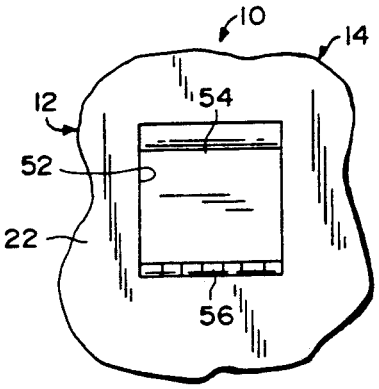
FIG. 5 is an elevational view taken in the direction of arrow 5 in FIG. 2, but with the door in a closed position.

Turning now descriptively to the drawings, in which like reference characters denote like elements throughout the several views, the Figures illustrate a spray mate cooler 10 which consists of a portable ice chest 12 being typically a box-shaped container 14 having bottom 16, front 18, back 20 and side 22 inter-connecting walls. A removable lid 24 is supported on the top edges of the box-shaped container 14 so that the box-shaped container 14 can receive and hold a supply of ice 26 therein for cooling. An elevating structure 28 is on the bottom wall 16 of the box-shaped container 14, for elevating the supply of ice 26 to permit cold water 30 of the melted ice to collect on the bottom wall 16. A mechanism 32 is for spraying the cold water 30 collected on the bottom wall 16 out through one of the side walls 22 of the box-shaped container 14.

The elevating structure 28 is a removable support member 34 having a perforated platform 36 and a plurality of legs 38 to elevate the perforated platform 36.

The spraying mechanism 32 includes an elongated hose 40 having a first end 42 on the bottom wall 16 under the perforated platform while a second end 44 extends through the side wall 22 of the box-shaped container 14. A spray nozzle gun 46 is fluidly connected to the second end 44 of the hose 40. The spraying mechanism 32 further includes a guide tube 48 connected by clamps 50 to the bottom wall 16 and the side wall 22 of the box-shaped container 14 so that the hose 40 can slide through the guide tube 48. The side wall 22 has an aperture 52 therethrough. A door 54 is hinged at 56 along its bottom edge to the aperture 52 in the side wall 22 so that the hose 40 can slideably extend outwardly therefrom. A latch mechanism 58 is connected between the door 54 and the side wall 22 so as to retain the door 54 in a closed position to the side wall 22 when the spray nozzle gun 46 is inserted within the side wall 22 and is not being used.

In operative use the water 30 that melts from the ice 26 that is used to keep typical food contents stored within the container 14 can be sprayed on the user's skin or into his/her mouth to help keep cool.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A spray mate cooler which comprises:

a) a portable ice chest being a box-shaped container having bottom, front, back and side inter-connecting walls;

b) a removable lid supported on the top edges of said box-shaped container so that said box-shaped container can receive and hold a supply of ice therein for cooling;

c) means on the bottom wall of said box-shaped container, for elevating the supply of ice to permit cold water of the melted ice to collect on the bottom wall; and d) means for spraying the cold water collected on the bottom wall out through one of the side walls of said box-shaped container.

2. A spray mate cooler as recited in claim 1, wherein said elevating means is a removable support member having a perforated platform and a plurality of legs to elevate the perforated platform.

3. A spray mate cooler as recited in claim 2, wherein said spraying mean includes:

a) an elongated hose having a first end on the bottom wall under said perforated platform while a second end extends through the side wall of said box-shaped container; and b) a spray nozzle gun fluidly connected to the second end of said hose.

4. A spray mate cooler as recited in claim 3, wherein said spraying means further includes:

a) a guide tube connected to the bottom wall and the side wall of said box-shaped container so that said hose can slide through said guide tube;

b) the side wall having an aperture therethrough;

c) a door hinged along its bottom edge to the aperture in the side wall so that said hose can slideably extend outwardly therefrom; and d) a latch mechanism connected between said door and the side wall so as to retain said door in a closed position to the side wall when said spray nozzle gun is inserted within the side wall and is not being used.

5. A spray mate cooler which comprises:

a) a portable ice chest container having a bottom wall and at least one top edge;

b) a removable lid supported on said at least one top edge of said container so that said container can receive and hold a supply of ice therein for cooling;

c) means on the bottom wall of said container, for elevating the supply of ice to permit cold water of the melted ice to collect on the bottom wall; and d) means for spraying the cold water collected on the bottom wall out through a side wall of said container.

6. A spray mate cooler as recited in claim 5, wherein said elevating means is a removable support member having a perforated platform and a plurality of legs to elevate the perforated platform.

7. A spray mate cooler as recited in claim 6, wherein said spraying mean includes:

a) an elongated hose having a first end on the bottom wall under said perforated platform while a second end extends through the side wall of said container; and b) a spray nozzle gun fluidly connected to the second end of said hose.

8. A spray mate cooler as recited in claim 7, wherein said spraying means further includes:

a) a guide tube connected to the bottom wall and the side wall of said container so that said hose can slide through said guide tube;

b) the side wall having an aperture therethrough; and c) an aperture in the side wall so that said hose can slideably extend outwardly therefrom.

* * * * *